US006220991B1

(12) United States Patent
Sellers

(10) Patent No.: US 6,220,991 B1
(45) Date of Patent: Apr. 24, 2001

(54) MOTORIZED EXERCISE BIKE

(76) Inventor: David H. Sellers, 980 Walther Blvd., Lawrenceville, GA (US) 30043-8425

( * ) Notice: Subject to any disclaimer, the term of this patent is extended or adjusted under 35 U.S.C. 154(b) by 0 days.

(21) Appl. No.: 09/490,158

(22) Filed: Jan. 22, 2000

(51) Int. Cl.[7] ..... A63B 21/00
(52) U.S. Cl. ..... 482/62; 482/63; 601/36
(58) Field of Search ..... 482/57–65, 73; 601/36

(56) References Cited

U.S. PATENT DOCUMENTS 3,213,852 * 10/1965 Zent ..... 601/36
3,991,749 * 11/1976 Zent ..... 601/36
4,284,462 8/1981 Heine .
4,402,502 * 9/1983 Peters ..... 482/62
4,895,362 * 1/1990 Ross ..... 482/62
4,981,294 1/1991 Dalebout et al. .
5,035,417 7/1991 Ross .
5,078,391 * 1/1992 Moore ..... 482/62
5,149,312 9/1992 Croft et al. .
5,342,261 * 8/1994 Johnston ..... 482/57
5,346,445 9/1994 Chang .
5,501,648 3/1996 Grigoriev .

* cited by examiner

*Primary Examiner*—Stephen R. Crow
(74) *Attorney, Agent, or Firm*—Kenneth L Tolar

(57) ABSTRACT

An exercise bicycle includes a frame having a pedal assembly mounted thereon. The pedal assembly is interlinked with an electric motor, a fan blade type wheel and a reciprocable handle bar assembly whereby the motor automatically rotates the pedal crank assembly and reciprocates the handle bars to provide a light, assisted workout to a physically challenged person.

5 Claims, 3 Drawing Sheets

MOTORIZED EXERCISE BIKE

BACKGROUND OF THE INVENTION

The present invention relates to a motorized exercise bicycle for the physically impaired or disabled.

DESCRIPTION OF THE PRIOR ART

The infirm, the elderly, those who have recently suffered debilitating injuries or diseases and similar physically disabled people often attempt a minimal amount of exercise during rehabilitation or to maintain minimum muscle strength or conditioning. However, conventional exercises such as walking, biking, jogging or swimming are typically too strenuous for a person with such physical disabilities, especially for those who have suffered a stroke or a similar serious medical emergency.

The present invention provides a motorized exercise bicycle in which a pedal assembly can be selectively rotated with a motor to exercise a user's legs resting thereon. Furthermore, the motor reciprocates a pair of handle bars to lightly work the arms and upper body.

Various exercise devices exist in the prior art. For example, U.S. Pat. No. 5,501,648 issued to Grigoriev relates to an exercise device including a front wheel and a reciprocating handle bar assembly attached to a frame. A clutch and a mechanical advantage device are utilized to drive the front wheel of the bicycle in response to the reciprocative displacement of the handle bar assembly.

U.S. Pat. No. 5,346,445 issued to Chang relates to an arm lever for an exercise bicycle including a pivot portion pivotably mounted on a front end of a bicycle frame and a bottom end connected to the end of a crank arm.

U.S. Pat. No. 5,149,312 issued to Croft et al relates to a quick release apparatus for a link member for an exercise bicycle.

U.S. Pat. No. 5,035,417 issued to Ross relates to an exercise bicycle including reciprocating arms which are interlinked with a flywheel such that movement of the arms causes rotation of the flywheel.

U.S. Pat. No. 4,981,294 issued to Dalebout et al relates to an exercise bicycle including a wheel having a plurality of fan blades to provide air resistance when the wheel is rotated. In addition, the hub of the wheel is circumferentially encompassed with a strap that may be tightened to increase the rotational resistance applied to the wheel.

Although various exercise bicycles and mechanisms therefor exist in the prior art, none include an electric motor for automatically driving a pedal assembly and reciprocating handle bars.

SUMMARY OF THE INVENTION

The present invention relates to a motorized exercise bicycle. The device comprises a frame having a fan blade type wheel mounted thereon. Interlinked with the wheel is a pedal assembly whereby rotation of the pedal results in rotation of the wheel. The bicycle also includes reciprocating handle bars which are likewise operably interlinked with the motor and are simultaneously reciprocated with rotation of the wheel. It is therefore an object of the present invention to provide an exercise bicycle having an electric motor assembly for automatically rotating a pedal assembly.

It is another object of the present invention to provide an exercise bicycle having automatically reciprocating handle bars.

It is yet another object of the present invention to provide an exercise bicycle specifically designed for the infirm, the elderly or other physically disabled people. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
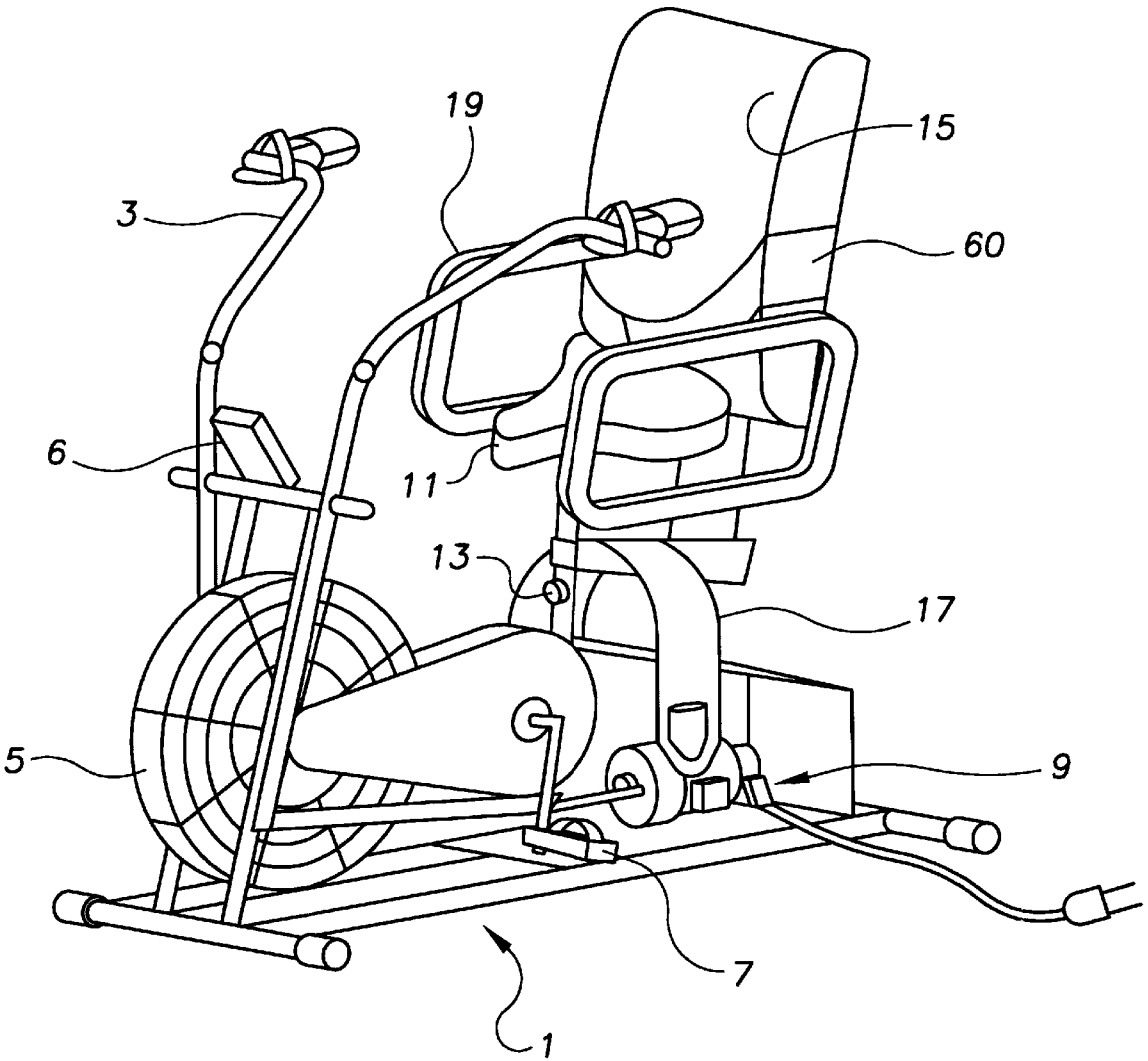
FIG. 1 is a perspective view of the exercise bicycle.
Figure 5:
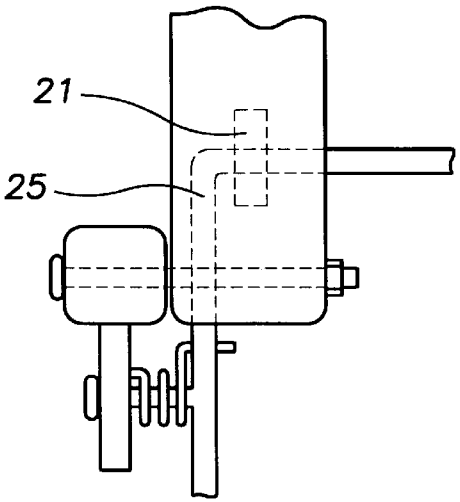
FIG. 5 is a side view of the latch mechanism depicted in FIG. 4.
Figure 4:
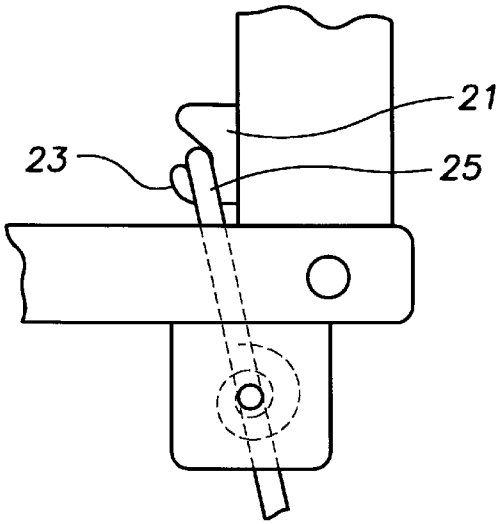
FIG. 4 depicts a front view of the seat side rail locking mechanism.

Referring now to FIGS. 1, 4 and 5, the present invention relates to a motorized exercise bicycle assembly. The device comprises in general a frame 1 for supporting various components including a pair of handle bars 3, a fan blade type wheel 5, a pedal assembly 7, a motor assembly 9 and a height adjustable seat 11. More specifically, the bicycle includes a seat 11 supported above the frame on an a telescoping adjustable rod 13. Vertically suspended adjacent the seat is a back rest 15 having a back strap 60 mounted thereon for encircling a user's abdomen. A seat belt 17 is attached to a support member disposed beneath the seat for encompassing a user's waist.

Figure 6:
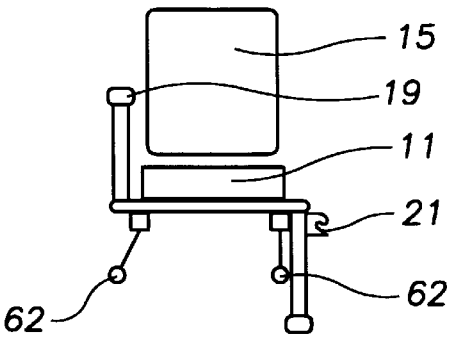
FIG. 6 depicts a side rail in a lowered position.

A pivotable side rail 19 is mounted on each of two sides of the seat. Each side rail is pivotably mounted to a bar extending beneath the seat. Each rail includes a fork 21 having an upwardly extending arcuate lower lip 23 which receives a spring-biased L-shaped lever 25 that retains the side rail in a vertical raised position. The lever is pivoted with a handle member 62 depending therefrom. To release the rail, the rail is pivoted towards the seat and the handle member is pivoted outwardly. The seat can then be freely pivoted outwardly to a lowered position as depicted in FIG. 6.

Figure 2:
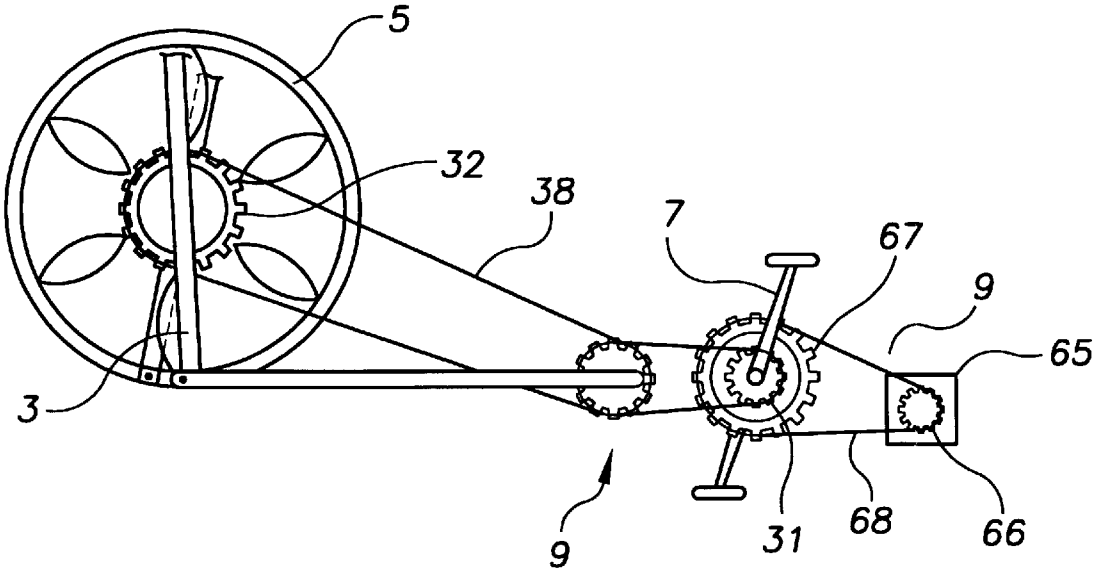
FIG. 2 is a side view of the motor assembly.
Figure 3:
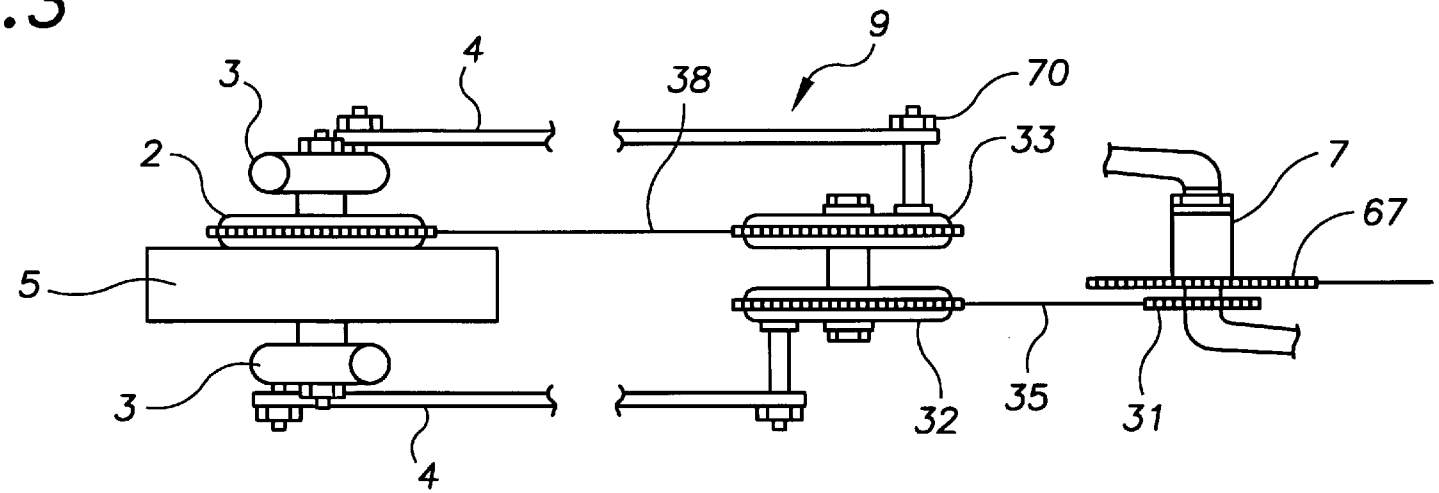
FIG. 3 is a top view of the motor assembly.

Now referring to FIGS. 2 and 3, the exercise bicycle also includes a motor assembly 9 for automatically rotating the pedals and wheel and for reciprocating the handle bars. The motor assembly includes a variable speed electric motor 65 that rotatably drives a motor sprocket 66. A first sprocket 67 is attached to the pedal assembly and includes a drive chain 68 encompassing the first sprocket and the motor sprocket allowing the motor to operably drive the pedal assembly. The motor preferably includes a sliding spur gear engagement for selectively detaching the drive chain from the motor sprocket thereby allowing the pedals to be manually rotated if desired. The motor may also include a magnetic slip clutch assembly for allowing the pedals to be rotated independently of the motor. A second, smaller sprocket 31 is mounted on the pedal assembly adjacent the first sprocket for driving a pair of geared drive members 32, 33. One of the drive members 32 is encompassed with a second chain 35 that likewise encompasses the second smaller sprocket on the pedal assembly. The other drive member 33 is encompassed with a third chain 38 that also encompasses a gear 2 on the fan blade wheel.

An elongated rod 4 is pivotably coupled with each drive member at a first end thereof. Each drive rod is pivotably coupled to a peripherally disposed shoulder bolt 70 on the drive member whereby rotation of each drive member results in a substantially linear reciprocation of the rod. The distal end of each rod is pivotally joined to the lower end of one of the reciprocating handle bars. An intermediate portion of each handle bar is pivotally attached to an end of a transverse member. The transverse member extends through a central aperture on both the fan wheel and fan sprocket. Accordingly, activation of the motor will result in synchronous and simultaneous rotation of the pedal assembly and the fan wheel as well as reciprocation of the handle bars.

A control panel 6 is also mounted on the frame assembly and includes a switch means as well as a speed control knob for activating and adjusting the speed of the motor. In addition, the control panel includes an Liquid Crystal Display that may be electrically coupled with various monitors allowing a user to monitor speed, elapsed time, heart rate, blood pressure and any other important data.

The device is not to be limited to the exact details of construction and enumerations of parts shown and described. As will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise bicycle comprising:

a frame;

a reciprocating handle bar assembly attached to said frame;

a pedal crank assembly mounted on said frame;

a wheel operably connected with said pedal crank assembly;

a motor means for automatically rotating said pedal assembly and for automatically reciprocating said handle bar assembly; said motor means including a motor sprocket on said motor; a first sprocket mounted on said pedal assembly; a drive chain encompassing said first sprocket and said motor sprocket; a second sprocket mounted on said pedal assembly; a pair of geared drive members; a second chain encompassing one of said drive members and said second sprocket; a gear attached to said wheel; a third chain encompassing said gear and the other of said geared drive members; a pair of elongated rods each pivotally attached at one end to a select drive member and at a second end to said handle bar assembly.

2. An exercise bicycle according to claim 1 further comprising a seat mounted on said frame, said seat having a side rail mounted on each of two opposing sides thereof, each of said side rails pivotable between a raised position and a lowered position.

3. An exercise bicycle according to claim 1 further comprising a backrest disposed adjacent said seat.

4. An exercise bicycle according to claim 3 further comprising: a strap attached to said backrest for encircling a user's abdomen.

5. An exercise bicycle according to claim 2 further comprising a seat belt mounted beneath said seat.

* * * * *